US006006176A

United States Patent [19]

Hayata

[11] Patent Number: 6,006,176

[45] Date of Patent: Dec. 21, 1999

[54] SPEECH CODING APPARATUS

[75] Inventor: Toshihiro Hayata, Tokyo, Japan

[73] Assignee: NEC Corporation, Tokyo, Japan

[21] Appl. No.: 09/105,193

[22] Filed: Jun. 26, 1998

[30] Foreign Application Priority Data

Jun. 27, 1997 [JP] Japan ..... 9-172068

[51] Int. Cl.[6] ..... G10L 3/02; G10L 9/00

[52] U.S. Cl. ..... 704/214; 704/215; 704/219

[58] Field of Search ..... 704/214, 219, 704/215, 201, 205, 207

[56] References Cited

U.S. PATENT DOCUMENTS

| | | | |
|---|---|---|---|
| 5,553,192 | 9/1996 | Hayata | 704/219 |
| 5,630,012 | 5/1997 | Nishiguchi et al. | 704/201 |
| 5,696,819 | 12/1997 | Suizu et al. | 379/390 |

FOREIGN PATENT DOCUMENTS

| | | |
|---|---|---|
| 59-26794 | 2/1984 | Japan . |
| 63-142399 | 6/1988 | Japan . |
| 2-120800 | 5/1990 | Japan . |
| 6-4087 | 1/1994 | Japan . |

*Primary Examiner*—Susan Wieland
*Attorney, Agent, or Firm*—Young & Thompson

[57] ABSTRACT

A speech coding apparatus which allows a speech decoding apparatus to output a more familiar background noise. The speech coding apparatus includes a voice presence/absence discrimination section, a coding section, a unique word production section, and a data switching section which selectively outputs one of outputs of the coding section and the unique word production section as an output of the speech coding apparatus in response to a result of discrimination of the voice presence/absence discrimination section. The speech coding apparatus further includes an amplitude level discrimination section, a clip processing section and an input switching section. The input switching section selects, when the input speech signal includes voice, the input speech signal, but when the input speech signal includes no voice and a code for updating background noise is to be produced, the input switching section selects the input speech signal after clip processing.

2 Claims, 7 Drawing Sheets

SPEECH CODING APPARATUS

BACKGROUND OF THE INVENTION

1. Field of the Invention

The present invention relates to a speech coding apparatus, and more particularly to a speech coding apparatus having a VOX (Voice Operated Transmitter) function.

2. Description of the Related Art

Conventionally, a speech coding apparatus of the type which has a VOX function is used to stop, when input voice is silent, transmission on the coding side and produce a certain kind of background noise on the decoding side as disclosed, for example, in Japanese Patent Laid-Open Application No. Heisei 5-122165 which is directed to a speech signal transmission method.

FIG. 7 shows in block diagram a general construction of a conventional speech coding apparatus. Referring to FIG. 7, the speech coding apparatus shown includes an input terminal 1 for a speech signal, a voice presence/absence discrimination section 2, a high efficiency coding section 3, a unique word production section 4, a data switching section 5 and an output terminal 6.

In a digital radio transmission system, a speech signal inputted from the input terminal 1 is cut out and processed for each frame. The length of the frame is, for example, 40 ms.

The voice presence/absence discrimination section 2 receives a speech signal for one frame from the input terminal 1 as an input thereto and discriminates whether or not the current frame is a voice present period in which voice is present or a voice absent period in which voice is absent. The high efficiency coding section 3 receives a speech signal for one frame from the input terminal 1 as an input thereto and converts the speech signal into high efficiency codes. The unique word production section 4 produces a preamble signal and a postamble signal. The preamble signal is used to indicate, upon transition from a voice absent period to a voice present period, the transition to a speech decoding apparatus (not shown). The postamble signal is used to indicate transition from a voice present period to a voice absent period and indicate that background noise updating codes are to be transmitted in a next frame. Further, the postamble signal is transmitted after every (T+2) frames while a voice absent period continues. It is to be noted that both of the preamble signal and the postamble signal have signal patterns which are not present in a high efficiency code system in an ordinary case. The data switching section 5 selects one of a high efficiency signal outputted from the high efficiency coding section 3 and a preamble signal or a postamble signal outputted from the unique word production section 4 in accordance with a result of discrimination of the voice presence/absence discrimination section 2 and outputs a selected one of the signals through the output terminal 6. The output terminal 6 transmits data selected by the data switching section 5 to the speech decoding apparatus.

If it is discriminated by the voice presence/absence discrimination section 2 that a current frame is a voice present period, then the data switching section 5 selects a high efficiency code produced by the high efficiency coding section 3 and outputs it through the output terminal 6. On the other hand, if it is discriminated that the current frame is a voice absent period, then the coding apparatus performs a VOX process which have such steps as described below:

(1) The data switching section 5 is switched so that a postamble signal produced by the unique word production section 4 is outputted through the output terminal 6.

(2) The, the data switching section 5 is switched so that a high efficiency code produced by the high efficiency coding section 3 is outputted through the output terminal 6. It is to be noted that a high efficiency code transmitted next to a postamble signal is hereinafter referred to as background noise updating code.

(3) Thereafter, the output through the output terminal 6 is stopped for a fixed time. It is assumed that, in the following expression, the fixed time is T frames (T is a constant).

(4) After the fixed time (T frames), the processes beginning with (1) above are repeated.

However, also during a voice absent period, the voice presence/absence discrimination section 2 performs voice presence/absence discrimination for each frame. If presence of voice is detected during a speech absent period, then in the frame, a preamble signal is produced by the unique word production section 4 irrespective of the VOX process. The data switching section 5 selects the preamble signal produced by the unique word production section 4 and outputs it through the output terminal 6. Then, ordinary processing in a speech present period is performed beginning with the following frame. In particular, the data switching section 5 selects a high efficiency code produced by the high efficiency coding section 3 and outputs it through the output terminal 6.

The speech decoding apparatus receives a coded signal transmitted from the output terminal 6 of the speech coding apparatus. When a postamble signal is received, the speech decoding apparatus recognizes that the current frame is a speech absent period, and produces, for a period of T frames, background noise using a background noise updating code received in a frame next to the postamble signal. It is to be noted that background noise is updated each time a new background noise updating code is received. If a preamble signal is received during a speech absent period, then the speech decoding apparatus recognizes that a speech present period begins with the next frame, and produces decoded voice from received high frequency codes.

In the following description, a frame with which a postamble signal is transmitted is referred to as postamble signal transmission frame; a frame with which a background noise updating signal is transmitted is referred to as background noise updating frame; a frame with which transmission is stopped is referred to as transmission stop frame; a frame with which a preamble signal is transmitted is referred to as preamble signal transmission frame; and any other frame than the frames mentioned is referred to as ordinary transmission frame.

The prior art described above has a problem in that background noise produced by the speech decoding apparatus in a voice absent period is an unnatural sound.

The first reason is that, since the background noise updating code outputted from the speech coding apparatus is transmitted after every (T+2) frames ((postamble signal transmission frame)+(background noise updating frame)+T frames), background noise produced from a same background noise updating code continues for (T+2) frames.

The second reason is that, since background noise is updated immediately after a background noise updating code is received, if the variation of the power value of background noise across the updating is large, then the background noise gives, at a break of the background noise (at the time of updating), an unfamiliar feeling to a listener decoded speech of the speech decoding apparatus.

SUMMARY OF THE INVENTION

It is an object of the present invention to provide a speech coding apparatus which allows a speech decoding apparatus to output background noise from which a listener is given a reduced unfamiliar feeling.

In order to attain the object described above, according to the present invention, there is provided a speech coding apparatus, comprising voice presence/absence discrimination means for receiving an input speech signal as an input thereto and discriminating whether the input speech signal includes voice or no voice, coding means for receiving the input speech signal as an input thereto and coding the input speech signal, unique word production means for producing a unique word, data switching means for selectively outputting one of an output of the coding means and an output of the unique word production means as an output of the speech coding apparatus in response to a result of discrimination of the voice presence/absence discrimination means, amplitude level discrimination means for successively receiving the input speech signal for a predetermined period of time as an input hereto and calculating an average amplitude level of the input speech signals inputted for the predetermined period, clip processing means for calculating a clip value for an amplitude level of the input speech signal using the average amplitude level and performing clip processing for the input speech signal using the clip value, and input switching means for selecting one of the input speech signal and the input speech signal after the clip processing has been performed such that, when the input speech signal includes voice, the input switching means selects the input speech signal, but when the input speech signal includes no voice and a code for updating background noise is to be produced to effect VOX processing, the input switching means selects the input speech signal obtained by the clip processing, and outputting the selected input speech signal to the coding means.

The clip processing mentioned above signifies processing of limiting an absolute value of an amplitude level to a predetermined value. In particular, where the input speech signal value is represented by x, the clip value by c which is equal to or larger than 0 ($c \geqq 0$), and the input speech signal value after clip processing is represented by y, the clip processing is represented by the following expression (1):

$$y = \begin{cases} x & \text{if } |x| \leqq c \\ \text{sign}(x) \times c & \text{otherwise} \end{cases} \quad (1)$$

where sign(x) represents a sign of x and is given by the following expression (2):

$$\text{sign}(x) = \begin{cases} +1 & \text{if } |x| \geqq 0 \\ -1 & \text{otherwise} \end{cases} \quad (2)$$

In the speech coding apparatus described above, the amplitude level discrimination means successively fetches the input speech signal for a predetermined period of time and calculates an average amplitude level of the input speech signals inputted for the predetermined period. The clip processing means performs clip processing for the input speech signal using the average amplitude level calculated by the amplitude level discrimination means. Further, the input switching means selectively inputs, when a code for updating background noise is to be produced, the input speech signal obtained by the clip processing of the clip processing means to the coding means.

With the speech coding apparatus, the variation of the amplitude level of the input speech signal used upon production of a background noise updating code is reduced by performing the clip processing for the input speech signal to be used for production of a background noise updating code. Consequently, the speech quality in a voice absent period can be augmented. As a result, the unfamiliar feeling of back ground noise which a listener of a speech decoding apparatus may have as the speech level varies suddenly can be reduced.

According to another aspect of the present invention, there is provided a speech coding apparatus, comprising voice presence/absence discrimination means for receiving an input speech signal as an input thereto and discriminating whether the input speech signal includes voice or no voice, coding means for receiving the input speech signal as an input thereto and coding the input speech signal, unique word production means for producing a unique word, data switching means for selectively outputting one of an output of the coding means and an output of the unique word production means as an output of the speech coding apparatus in response to a result of discrimination of the voice presence/absence discrimination means, code storage means for storing a first code of a signal outputted last from the speech coding apparatus, and code conversion means for receiving a second code outputted from the coding means and the first code outputted from the code storage means, comparing a first power code of the first code and a second power code of the second code with each other and outputting, when a difference between power values of the first power code and the second power code is equal to or higher than a predetermined threshold value, the second code but varying, when the difference between the power values of the first power code and the second power code is higher than the predetermined threshold value, a value of the second power code so that the difference between the power values may be lower than the predetermined threshold value and outputting a code corresponding to the varied second power code as a new second code, the data switching means selecting the output of the code conversion means when the input speech signal includes no voice and a code for updating background noise is to be produced to effect VOX processing.

Here, the power code signifies a code of a high efficiency code which represents a power value of an input speech signal.

In the speech coding apparatus described above, the code storage means stores a first code of a signal outputted last from the speech coding apparatus. The code conversion means compares, when a background noise updating code is to be transmitted, a power code of a first code transmitted last from the speech coding apparatus and another power code of a second code for background noise updating produced currently with each other and, when the difference between power values of the two power codes is equal to or higher than the predetermined threshold value, the code conversion means varies the value of the second power code produced currently so that the difference between the power values may be lower than the predetermined threshold value, and transmits a code corresponding to the varied power code as a new second code.

With the speech coding apparatus, the variation of the amplitude level of the input speech signal used upon production of a background noise updating code is reduced by varying, when the power difference between the power code of a background noise updating code produced currently and the power code of a high efficiency code transmitted last is higher than the predetermined threshold value, the value of the power code of the background noise updating code produced currently and transmitting a high efficiency code corresponding to the varied power code as a new background noise updating code. Consequently, the speech quality in a voice absent period can be augmented. As a result, the unfamiliar feeling of back ground noise which a listener of a speech decoding apparatus may have as the speech level varies suddenly can be reduced.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENTS

Figure 1:
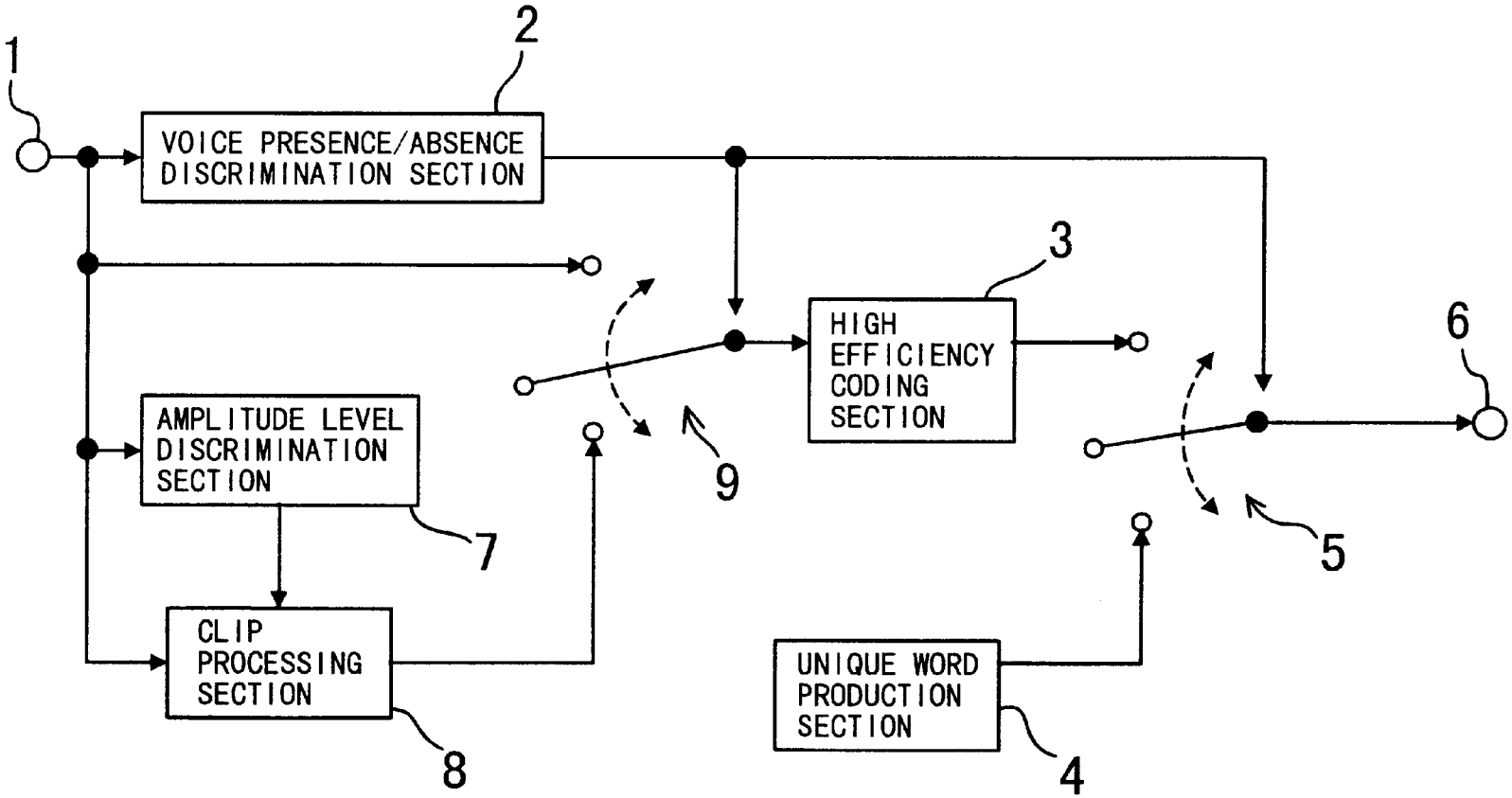
FIG. 1 is a block diagram of a construction of a speech coding apparatus to which the present invention is applied.

Referring first to FIG. 1, there is shown in block diagram a speech coding apparatus to which a first embodiment of the present invention is applied. The coding apparatus shown includes an input terminal 1 for a speech signal, a voice presence/absence discrimination section 2, a high efficiency coding section 3, a unique word production section 4, a data switching section 5, an output terminal 6, an amplitude level discrimination section 7, a clip processing section 8, and an input switching section 9.

In a digital radio transmission system, a speech signal inputted from the input terminal 1 is cut out and processed for each frame. The length of the frame is, for example, 40 ms.

The voice presence/absence discrimination section 2 receives a speech signal for one frame as an input thereto from the input terminal 1 and discriminates whether the current frame inputted is a voice present period or a voice absent period. The high efficiency coding section 3 receives an input speech signal for one frame from the input terminal 1 as an input thereto and converts it into high efficiency codes. The unique word production section 4 produces a preamble signal and a postamble signal. The postamble signal is transmitted after every (T+2) frames while a voice absent period continues. It is to be noted that both of the preamble signal and the postamble signal have signal patterns which are not present in a high efficiency code system in an ordinary case. The data switching section 5 selects one of a high efficiency signal outputted from the high efficiency coding section 3 and a preamble signal or a postamble signal outputted from the unique word production section 4 in accordance with a result of discrimination of the voice presence/absence discrimination section 2 and outputs a selected one of the signals through the output terminal 6. The output terminal 6 transmits data selected by the data switching section 5 to the speech decoding apparatus. However, with a transmission stop frame, nothing is transmitted.

The amplitude level discrimination section 7 fetches an input speech signals from the input terminal 1 for a long period of time, calculates an average amplitude level of the input speech signals and conveys the average amplitude level to the clip processing section 8. The clip processing section 8 performs, using an average amplitude level calculated by the amplitude level discrimination section 7, clip processing with a predetermined clip value for an input speech signal for one frame inputted thereto from the input terminal 1. Here, the clip processing signifies processing described in the summary of the invention hereinabove. The input switching section 9 selects a speech signal to be inputted to the high efficiency coding section 3 in accordance with a result of discrimination of the voice presence/absence discrimination section 2. When the current frame is an ordinary voice present period, the input switching section 9 inputs the speech signal inputted thereto from the input terminal 1 as it is to the high efficiency coding section 3, but when the current frame is a voice absent period, the input switching section 9 inputs a speech signal, for which clip processing has been performed by the clip processing section 8, to the high efficiency coding section 3.

The data switching section 5 selects one of the following five operations in response to a variation between a voice present period and a voice absent period to switch data to be outputted to the output terminal 6.

(1) When the current frame is an ordinary transmission frame, a high efficiency code is transmitted as it is.
(2) When the current frame is a background noise updating frame, a background noise updating code is transmitted.
(3) When the current frame is a preamble signal transmission frame, a preamble signal is transmitted.
(4) When the current frame is a postamble signal transmission frame, a postamble signal is transmitted.
(5) When the current frame is a transmission stop frame, transmission is stopped and nothing is transmitted.

Figure 2:
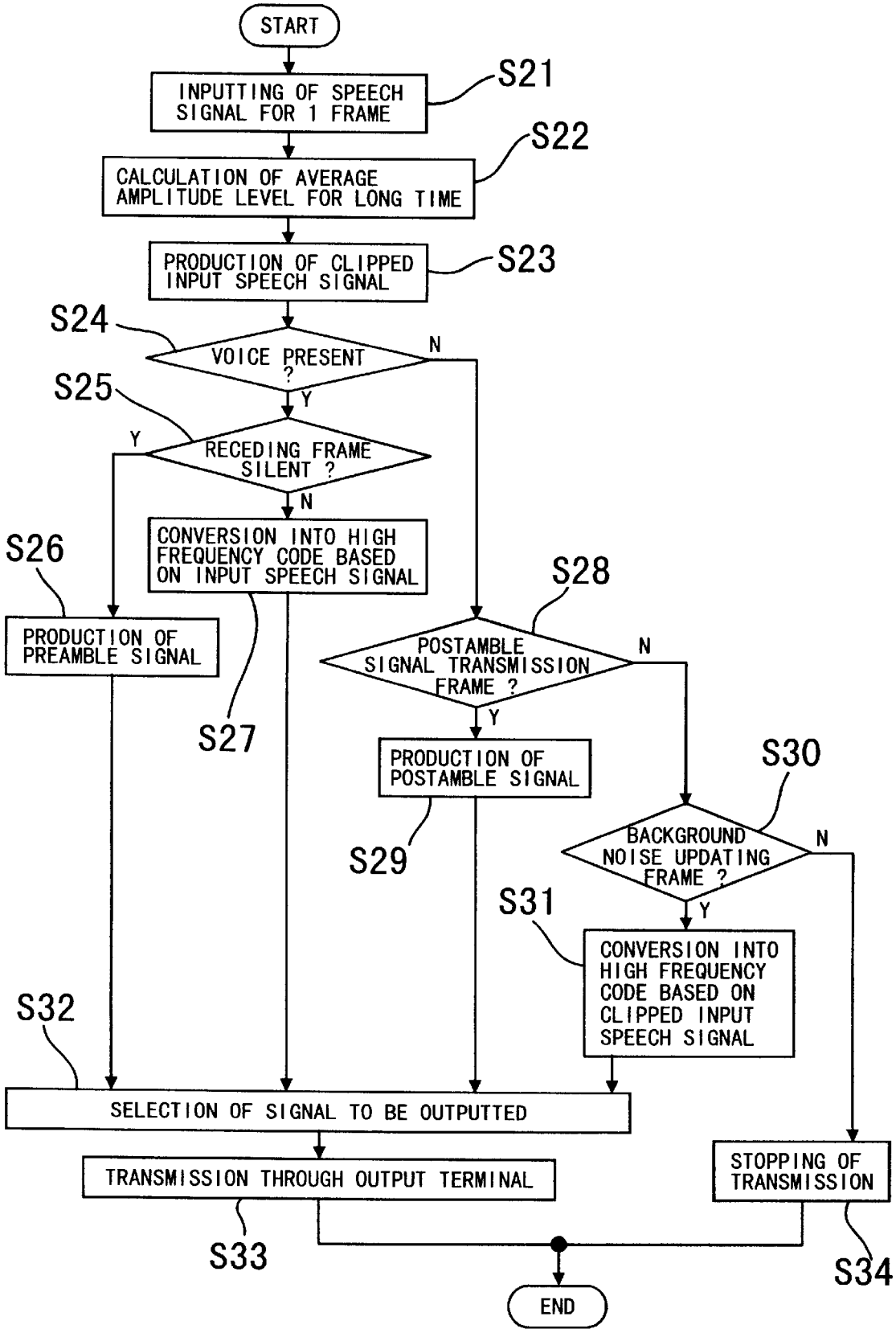
FIG. 2 is a flow chart illustrating operation of the speech coding apparatus of FIG. 1.

Operation of the speech coding apparatus described above with reference to FIG. 1 is described with additional reference to FIG. 2 which is a flow chart illustrating operation of the speech coding apparatus of FIG. 1.

First, an input speech signal for one frame is inputted from the input terminal 1 (step 21: hereinafter referred to as S21). The amplitude level discrimination section 7 calculates an average amplitude level from speech signals in the past stored in advance therein and the input speech signal of the current frame and updates the stored past speech signals (S22). The calculated average amplitude level is inputted to the clip processing section 8, by which a clip value is calculated and a speech signal which is the inputted speech signal for which clip processing is performed with the average amplitude level is produced (S23). The input speech signal is inputted to the voice presence/absence discrimination section 2, by which it is discriminated whether or not the current frame is EL voice present period or a voice absent period (S24).

If it is discriminated in S24 that the current frame is a voice present period, then it is detected whether or not a frame just preceding to the current frame was a voice present period (S25).

If it is discriminated in S25 that the preceding frame to the current frame was a voice absent period, then the unique word production section 4 produces a preamble signal (S26).

The produced preamble signal is selected by the data switching section 5 (S32) and transmitted through the output terminal 6 to the speech decoding apparatus (S33). This is the operation when a preamble signal transmission frame is transmitted.

On the other hand, if it is discriminated in S25 that the frame just preceding to the current frame was a voice present period, then the input speech signal is inputted to the high efficiency coding section 3, by which a high efficiency code is produced (S27). The produced high efficiency code is selected by the data switching section 5 (S32) and transmitted through the output terminal 6 to the speech decoding apparatus (S33). This is the operation when an ordinary transmission frame is transmitted.

Meanwhile, if it is discriminated in S24 that the current frame is a voice absent period, then it is discriminated whether or not the current frame is a postamble signal transmission frame (S28).

If it is discriminated in S28 that the current frame is a postamble frame transmission frame, then the unique word production section 4 produces a postamble signal (S29). The produced postamble signal is selected by the data switching section 5 (S32) and transmitted through the output terminal 6 to the speech decoding apparatus (S33). This is the operation when a postamble signal transmission frame is the transmitted.

If it is discriminated in S28 that the current frame is not a postamble signal transmission frame, then it is discriminated whether or not the current frame is a background noise updating frame (S30).

If it is discriminated in S30 that the current frame is a background noise updating frame, then selection of the input switching section 9 is switched so that a clipped input speech signal produced by the clip processing section 8 is inputted to the high efficiency coding section 3, by which a high efficiency code is produced (S31). The thus produced high efficiency code is a background noise updating code, and this background noise updating code is selected by the data switching section 5 (S32) and transmitted through the output terminal 6 to the speech decoding apparatus (S33). This is the operation when a background noise updating frame is transmitted.

If it is discriminated in step S30 that the current frame is not a background noise updating frame, then since this signifies that the current frame is a transmission stop frame, transmission through the output terminal 6 of the speech coding apparatus is stopped in the current frame (S34). This is the operation when a transmission stop frame is transmitted, that is, when nothing is transmitted.

Figure 3:
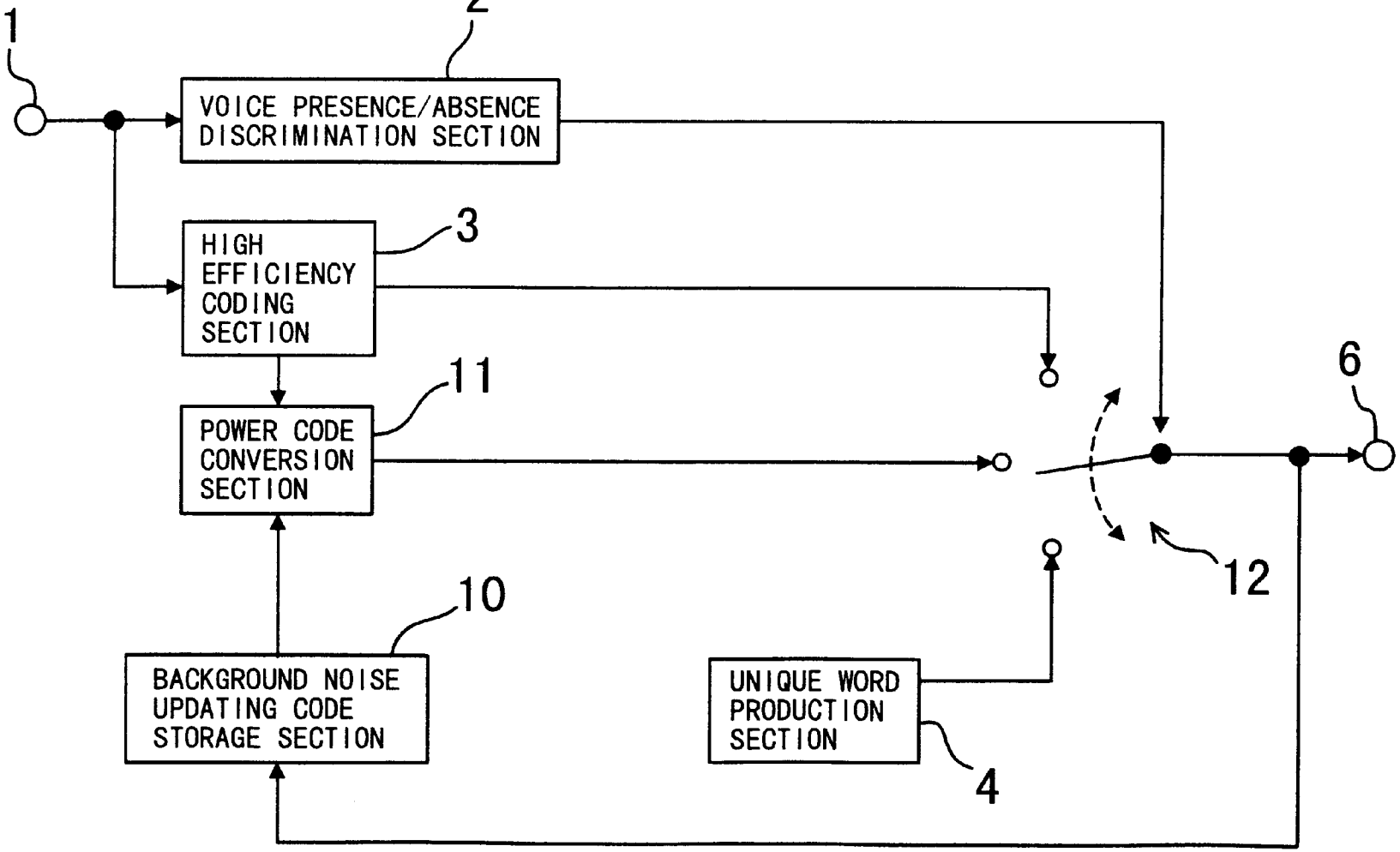
FIG. 3 is a block diagram of a construction of another speech coding apparatus to which the present invention is applied.

FIG. 3 shows in block diagram another speech coding apparatus to which a second embodiment the present invention is applied. Referring to FIG. 3, the speech coding apparatus shown includes an input terminal 1 for a speech signal, a voice presence/absence discrimination section 2, a high efficiency coding section 3, a unique word production section 4, an output terminal 6, a background noise updating code storage section 10, a power code conversion section 11 and an output data switching section 12. Like reference numerals in FIG. 3 to those of FIG. 1 denote like elements, and overlapping description of them is omitted here to avoid redundancy.

The background noise updating code storage section 10 stores a high efficiency code which has been transmitted last through the output terminal 6 to a speech decoding apparatus (not shown). Here, the high efficiency code which has been transmitted last signifies that one of high efficiency codes transmitted to the speech decoding apparatus other than a postamble signal, a preamble signal and transmission stopping which has been transmitted nearest to the present point of time. For example, where a voice present period continues, the high efficiency code which has been transmitted last is a high efficiency code in the voice present period of the last frame. On the other hand, in a voice absent period, the high efficiency code which has been transmitted last is a background noise updating code.

The power code conversion section 11 receives a background noise updating code for the current frame produced by the high efficiency coding section 3 in a voice absent period and a high efficiency code transmitted last and stored in the background noise updating code storage section 10 as inputs thereto. Then, the power code conversion section 11 compares power codes which represent power values of the frames of the two high efficiency codes with each other and varies the value of the power code of the background noise updating code for the current frame so that the difference between the two power codes may become lower than a threshold level. Then, the power code conversion section 11 transmits a high efficiency code corresponding to the thus varied power code as a new background noise updating code.

The output data switching section 12 switches data to be outputted to the output terminal 6 in accordance with a result of discrimination of the voice presence/absence discrimination section 2. Operation of the output data switching section 12 when the current frame is a preamble signal transmission frame, a postamble signal transmission frame or a transmission stop frame is similar to that in the speech coding apparatus described hereinabove with reference to FIG. 1, and operation of the output data switching section 12 only when the current frame is an ordinary transmission frame or a background noise updating frame is different from that in the speech coding apparatus of FIG. 1. In the following, operation only when the current frame is an ordinary transmission frame or a background noise updating frame is described.

When the current frame is an ordinary transmission frame, an input speech signal inputted from the input terminal 1 is inputted to the high efficiency coding section 3, by which it is converted into a high efficiency code, and the high efficiency code is selected by the output data switching section 12 and outputted through the output terminal 6. Further, the high efficiency code is stored into the background noise updating code storage section 10.

When the current frame is a background noise updating frame, an input speech signal inputted from the input terminal 1 is inputted to the high efficiency coding section 3, by which it is converted into a high efficiency code. This high efficiency code becomes a background noise updating code of the current frame. Then, the background noise updating code of the current frame and a high efficiency code transmitted last and stored in the background noise updating code storage section 10 are inputted to the power code conversion section 11. The power code conversion section 11 compares power codes of the two inputted high efficiency codes. Then, if the difference between power values of the two power codes is large, then the power code conversion section 11 varies the power code of the background noise updating code of the current frame so that the difference may be decreased and produces and determines a high efficiency code corresponding to the thus varied power code as a new background noise updating code for the current frame. Then, the background noise updating code produced by the power code conversion section 11 is selected by the output data switching section 12 and outputted through the output terminal 6, and is also stored into the background noise updating code storage section 10.

The output data switching section 12 is different from the data switching section 5 of the speech coding apparatus described hereinabove with reference to FIG. 1 in that, when the current frame is a background noise updating frame, while the data switching section 5 shown in FIG. 1 selects a high efficiency code produced by the high efficiency coding section 3, the output data switching section 12 shown in FIG. 3 selects a background noise updating code produced by the power code conversion section 11.

Operation of the speech coding apparatus of FIG. 3 is described below with additional reference to FIG. 4 which is a flow chart illustrating operation of the speech coding apparatus of FIG. 3.

In the operation of the speech coding apparatus illustrated in FIG. 4, operation when the current frame is a preamble signal transmission frame (S54), a postamble signal transmission frame (S57) or a transmission stop frame (S64) is similar to that of the speech coding apparatus described hereinabove with reference to FIG. 2, but operation only when the current frame is an ordinary transmission frame or a background noise updating frame is different from that illustrated in FIG. 2. In the following, description is given only of operation when the current frame is an ordinary transmission frame or a background noise updating frame.

First, an input speech signal for one frame is inputted from the input terminal 1 (S51). The input speech signal is inputted to the voice presence/absence discrimination section 2, by which it is discriminated whether or not the current frame is a voice present period or a voice absent period (S52).

If it is discriminated in S52 that the current frame is a voice present period, then it is discriminated whether or not a frame just preceding to the current frame was a voice present period (S53).

If it is discriminated in S53 that the frame just preceding to the current frame was a voice present period, then the input speech signal is inputted as it is to the high efficiency coding section 3, by which a high efficiency code is produced (S55). The produced high efficiency code is stored into the background noise updating code storage section 10 (S61). Further, the high efficiency code is selected by the output data switching section 12 (S62) and transmitted through the output terminal 6 to the speech decoding apparatus (S63). This is the operation when the current frame is an ordinary transmission frame.

If it is discriminated in S52 that the current frame is a voice absent period, then it is discriminated whether or not the current frame is a postamble signal transmission frame (S56).

If it is discriminated in S53 that the current frame is not a postamble signal transmission frame (S56), then it is discriminated whether or not the current frame is a background noise updating frame (S58).

If it is discriminated in S58 that the current frame is a background noise updating frame, then the input speech signal is inputted as it is to the high efficiency coding section 3, by which a high efficiency code is produced (S59). The thus produced high efficiency code is a background noise updating code for the current frame. The back ground noise updating code for the current frame and the high efficiency code transmitted last and stored in the background noise updating code storage section 10 are inputted to the power code conversion section 11, by which power codes of the two high efficiency codes are compared with each other. Then, if the difference between power values represented by the power codes is large, then the power code conversion section 11 varies the power code of the background noise updating code for the current frame so that the difference may be decreased and determines a high efficiency code Corresponding to the varied power code as a new background noise updating code for the current frame (S60). The background noise updating code calculated by the power code conversion section 11 is stored into the background noise updating code storage section 10 (S61). Further, the background noise updating code is selected by the output data switching section 12 (S62) and transmitted through the output terminal 6 to the speech decoding apparatus (S63). This is the operation when the current frame is a background noise updating frame.

In a first working example, in S22 of the amplitude level discrimination section 7 and the operation in S23 of the clip processing section 8 of the speech coding apparatus described hereinabove with reference to FIGS. 1 and 2 are described in more detail with reference to FIGS. 1 and 2 and FIG. 5 which illustrate a relationship between an average amplitude level of an input speech signal and a clip coefficient in the speech coding apparatus of FIG. 1.

In S22 of FIG. 2, the amplitude level discrimination section 7 executes calculation of the following expression (3) to calculate an average amplitude level ave:

$$ave = \frac{\sum_{i=0}^{N-1} |in[i]| + \sum_{i=0}^{Npre-1} |pre[i]|}{N + Npre} \tag{3}$$

where ave is the average amplitude level, N the number of speech signals for one Frame, Npre the number of speech signals in the past stored in the amplitude level discrimination section 7, which is equal to or larger than N (Npre≧N), in[i] the amplitude of the ith speech signal of the current frame, |in[i]| the absolute value of in[i], and |pre[i]| the absolute value of pre[i].

Further in S22, the amplitude level discrimination section 7 executes calculation of the following expression (4) to update the input speech signal pre[i] (i=0 to (Npre−1); the higher the value of i, the older the value) in the past preceding by (i+1) stored therein:

$$pre[i] = \begin{cases} in[N-i-1] & \text{if } 0 \leqq i \leqq (N-1) \\ pre[i-N] & \text{if } N \leqq i \leqq (Npre-1) \end{cases} \tag{4}$$

In S23, the clip processing section 8 executes calculation of the following expression (5) to calculate a clip value for the amplitude level:

$$CL = \alpha(ave) \times ave \tag{5}$$

where CL is the clip value, ave the average amplitude value, and α(ave) the clip coefficient.

Further in S23, the clip processing section 8 executes calculation of the following expression (6) to determine a clipped input speech signal obtained by performing clipping processing for an input speech signal:

$$CLin[i] = \begin{cases} in[i] & \text{if } |in[i]| \leqq CL \\ \text{sign}(in[i]) \times CL & \text{otherwise} \end{cases} \tag{6}$$

where Clin[i] is the ith clipped input speech signal, in[i] the amplitude of the ith speech signal of the current frame, and sign(in[i]) the sign of in[i] given by the following expression (7):

$$\text{sign}(in[i]) = \begin{cases} +1 & \text{if } in[i] \geqq 0 \\ -1 & \text{otherwise} \end{cases} \quad (7)$$

Figure 5:
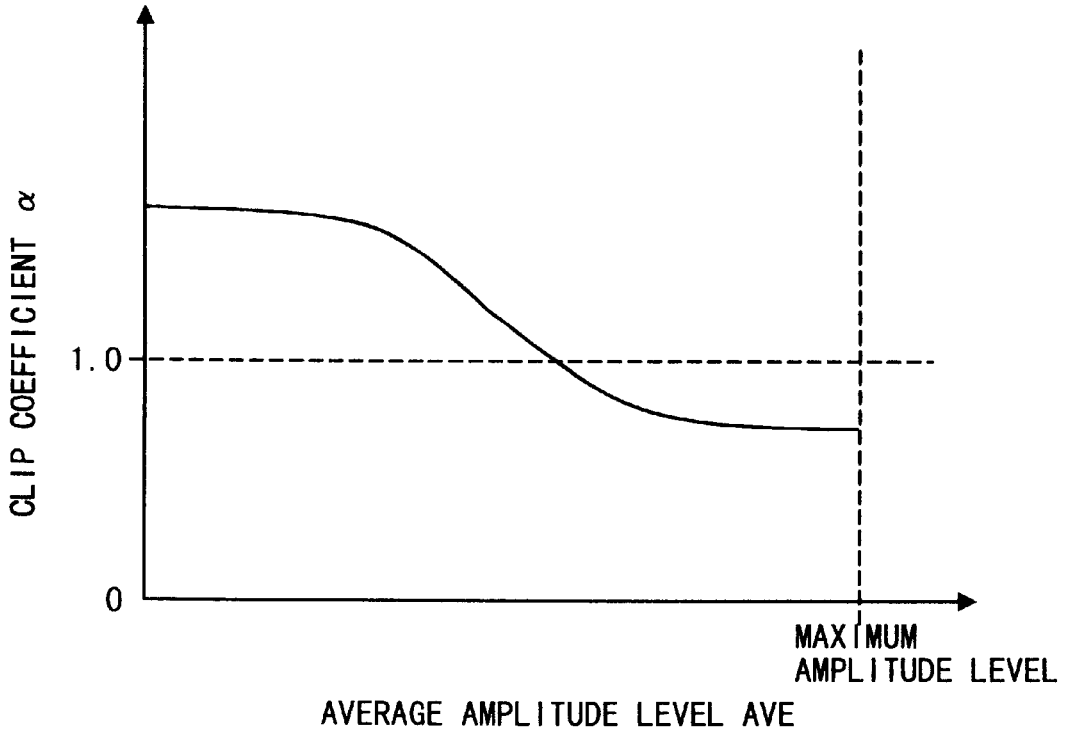
FIG. 5 is a diagram illustrating a relationship between an average amplitude level of an input speech signal and a clip coefficient in the speech coding apparatus of FIG. 1.

The clip coefficient α(ave) used in the expression (5) above may have, for example, such a characteristic as illustrated in FIG. 5.

Figure 4:
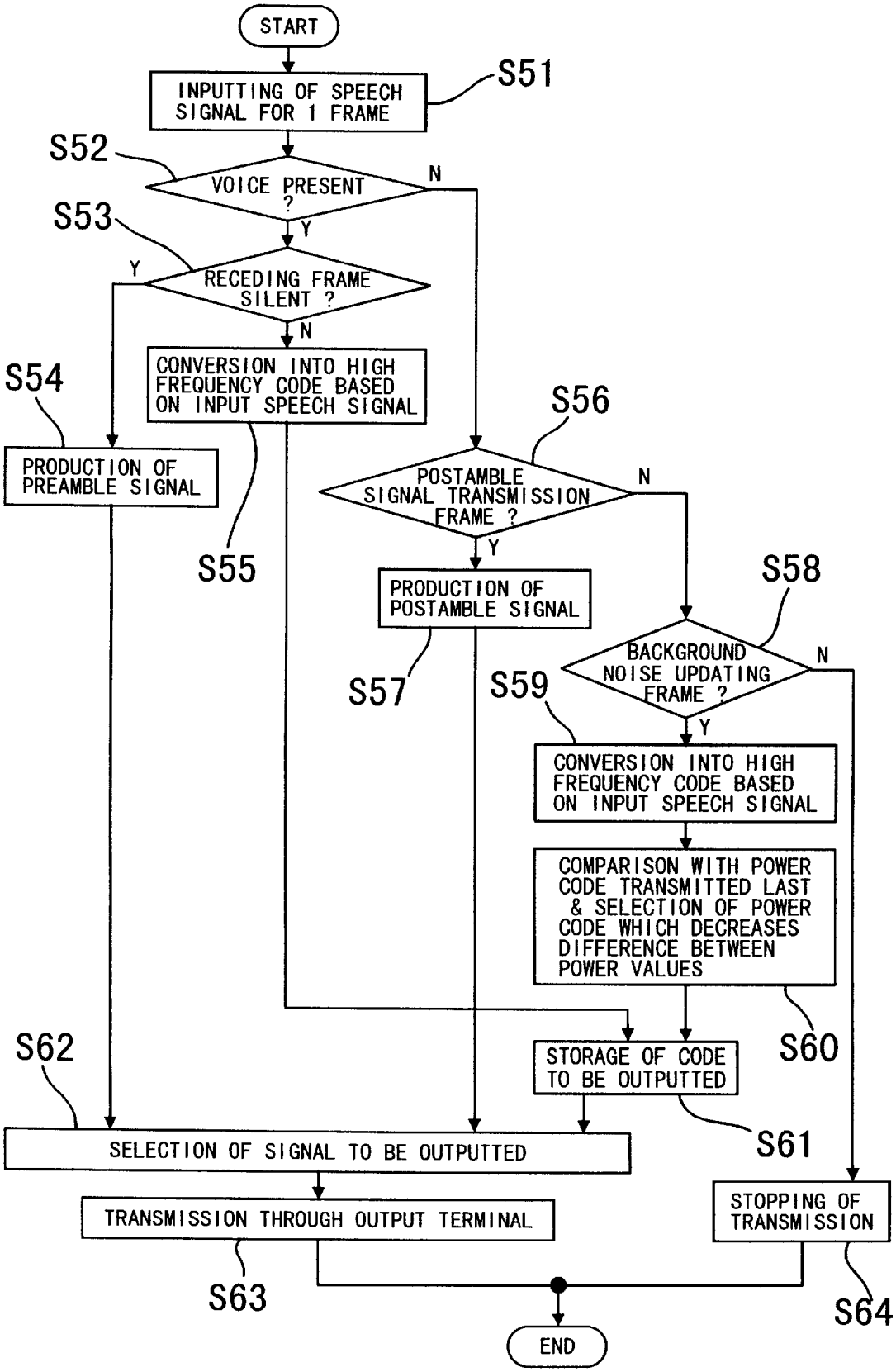
FIG. 4 is a flow chart illustrating operation of the speech coding apparatus of FIG. 3.

In a second working example the operation in S60 of the power code conversion section 11 of the speech coding apparatus described hereinabove with reference to FIGS. 3 and 4 is described in more detail with reference to FIGS. 3 and 4 and FIG. 6 which illustrates a relationship between a power value and a threshold value for a difference between power values in the speech coding apparatus of FIG. 3.

In S60, the power code conversion section 11 executes calculation of the following expression (8) to convert a power code GAINcorr:

$$GAIN_{corr} = \begin{cases} GAIN & \text{if } |A| \leqq TH(GAINpre) \\ g(f(GAINpre) + TH(GAINpre)) & \text{if } A > TH(GAINpre) \\ g(f(GAINpre) - TH(GAINpre)) & \text{if } A < -TH(GAINpre) \end{cases} \quad (8)$$

where GAINcorr is the power code obtained by the conversion of the power code conversion section 11, GAIN the power code of a background noise updating code for the current frame, GAINpre the power code in a high efficiency code transmitted last, stored in the background noise updating code storage section 10, TH(g) the threshold value for the difference between power values when the power code is g, f(x) the function for converting the power code x into a power value, and g(y) the function for converting a power value y into a power code, and A is given by f(GAIN)—f (GAINpre).

Figure 6:
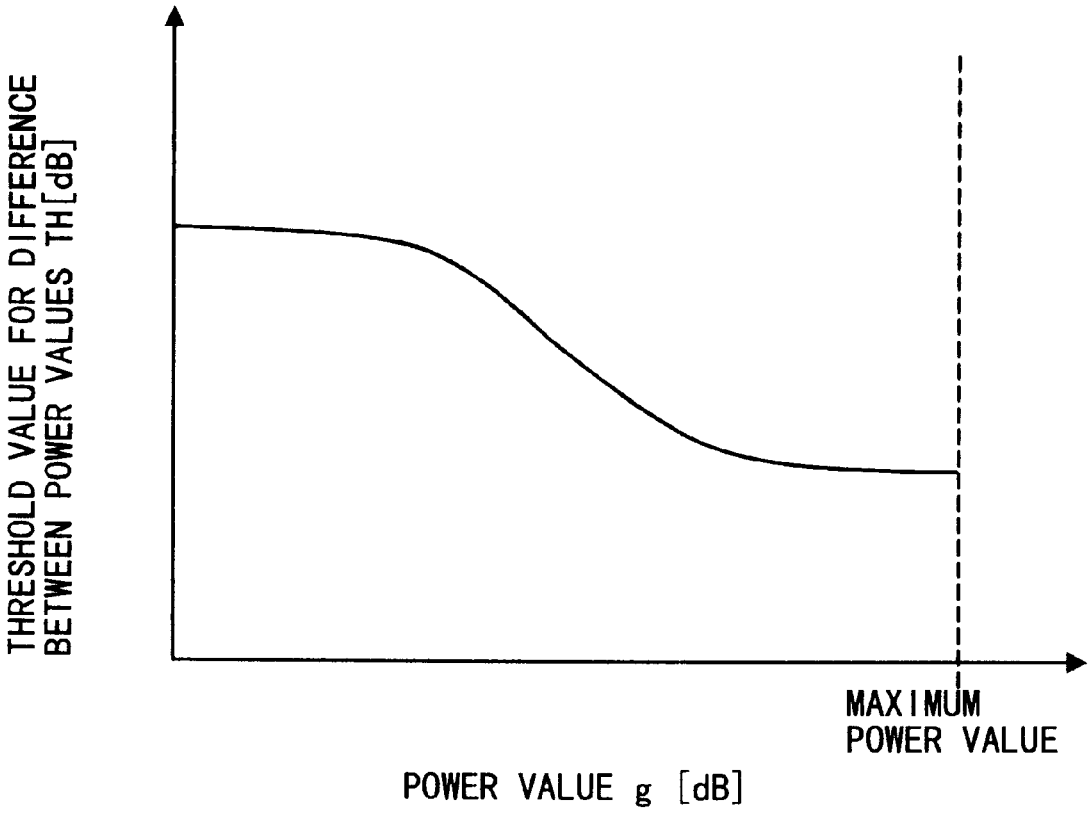
FIG. 6 is a similar view but illustrating a relationship between a power value and a threshold value for a difference between power values in the speech coding apparatus of FIG. 3.
Figure 7:
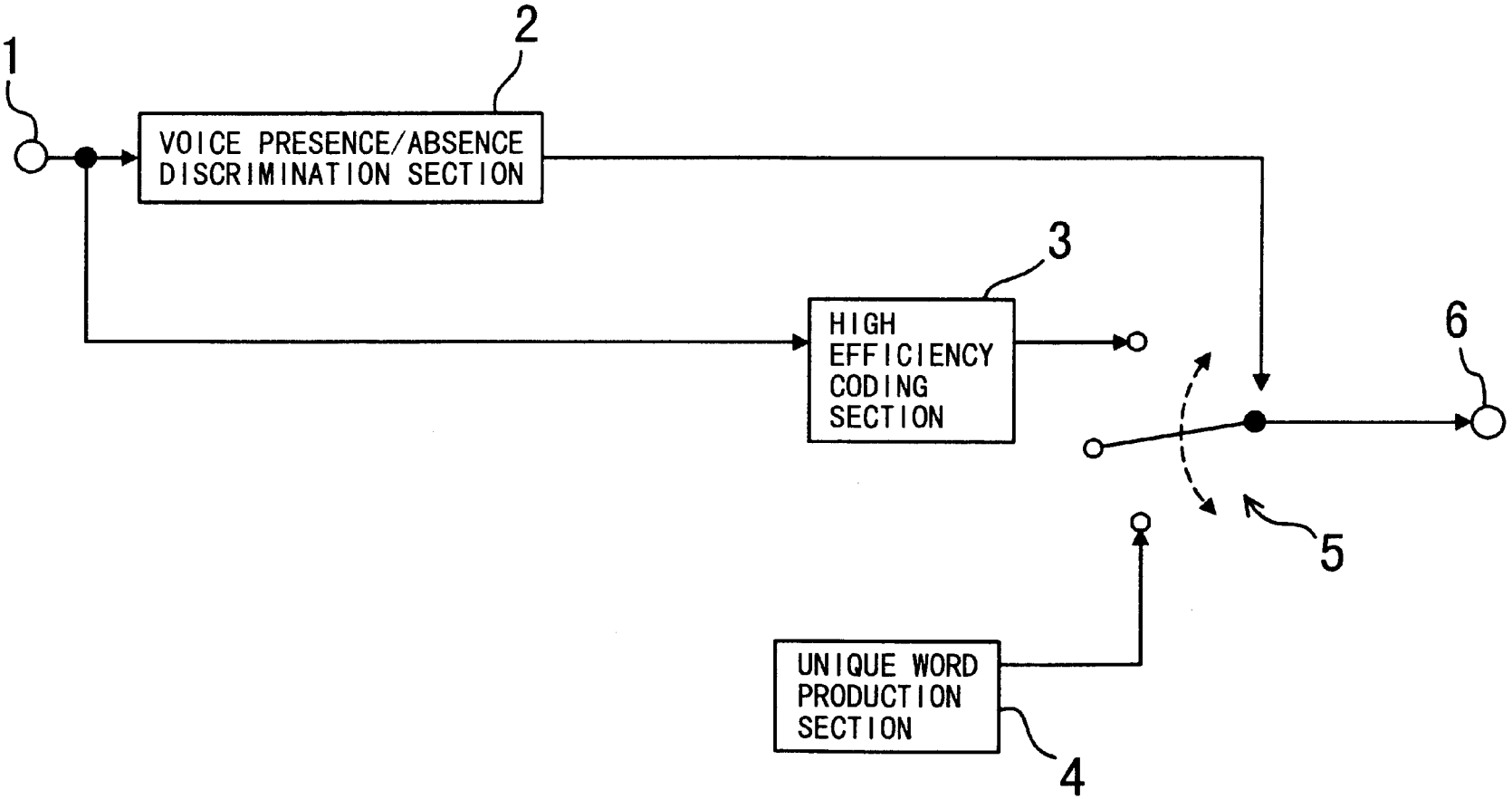
FIG. 7 PRIOR ART
FIG. 7 is a block diagram showing a construction of a conventional speech coding apparatus.

The threshold value TH(g) for the difference between power values used in the expression (8) above may have, for example, such a characteristic as illustrated in FIG. 6.

While preferred embodiments of the present invention have been described using specific terms, such description is for illustrative purposes only, and it is to be understood that changes and variations may be made without departing from the spirit or scope of the following claims.

What is claimed is:

1. A speech coding apparatus, comprising:

voice presence/absence discrimination means for receiving an input speech signal as an input thereto and discriminating whether the input speech signal includes voice or no voice;

coding means for receiving the input speech signal as an input thereto and coding the input speech signal;

unique word production means for producing a unique word;

data switching means for selectively outputting one of an output of said coding means and an output of said unique word production means as an output of said speech coding apparatus in response to a result of discrimination of said voice presence/absence discrimination means;

amplitude level discrimination means for successively receiving the input speech signal for a predetermined period of time as an input hereto and calculating an average amplitude level of the input speech signals inputted for the predetermined period;

clip processing means for calculating a clip value for an amplitude level of the input speech signal using the average amplitude level and performing clip processing for the input speech signal using the clip value; and input switching means for selecting one of the input speech signal and the input speech signal after the clip processing has been performed such that, when the input speech signal includes voice, said input switching means selects the input speech signal, but when the input speech signal includes no voice and a code for updating background noise is to be produced to effect VOX processing, said input switching means selects the input speech signal obtained by the clip processing, and outputting the selected input speech signal to said coding means.

2. A speech coding apparatus, comprising:

voice presence/absence discrimination means for receiving an input speech signal as an input thereto and discriminating whether the input speech signal includes voice or no voice;

coding means for receiving the input speech signal as an input thereto and coding the input speech signal;

unique word production means for producing a unique word;

data switching means for selectively outputting one of an output of said coding means and an output of said unique word production means as an output of said speech coding apparatus in response to a result of discrimination of said voice presence/absence discrimination means;

code storage means for storing a first code of a signal outputted last from said speech coding apparatus; and code conversion means for receiving a second code outputted from said coding means and the first code outputted from said code storage means, for comparing a first power code representing a power value of the first code and a second power code representing a power value of the second code with each other and outputting, when a difference between power values of the first power code and the second power code is equal to or less than a predetermined threshold value, the second code, and for varying a value of the second power code when the difference between the power values of the first power code and the second power code is higher than the predetermined threshold value so that the difference between the power values may be lower than the predetermined threshold value and outputting a code corresponding to the varied second power code as a new second code;

said data switching means selecting the output of said code conversion means when the input speech signal includes no voice and a code for updating background noise is to be produced to effect VOX processing.

* * * * *